US011227619B2

(12) United States Patent
Park et al.

(10) Patent No.: US 11,227,619 B2
(45) Date of Patent: Jan. 18, 2022

(54) MICROPHONE, ELECTRONIC APPARATUS INCLUDING MICROPHONE AND METHOD FOR CONTROLLING ELECTRONIC APPARATUS

(71) Applicant: Samsung Electronics Co., Ltd., Suwon-si (KR)

(72) Inventors: Jeheon Park, Hwaseong-si (KR); Kiwon Kim, Suwon-si (KR); Sunghoon Kim, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/645,857

(22) PCT Filed: Oct. 4, 2018

(86) PCT No.: PCT/KR2018/011734
§ 371 (c)(1),
(2) Date: Mar. 10, 2020

(87) PCT Pub. No.: WO2019/074238
PCT Pub. Date: Apr. 18, 2019

(65) Prior Publication Data

US 2020/0273478 A1 Aug. 27, 2020

(30) Foreign Application Priority Data

Oct. 12, 2017 (KR) ..... 10-2017-0132307

(51) Int. Cl.
*G10L 21/0232* (2013.01)
*G10L 25/51* (2013.01)
(Continued)

(52) U.S. Cl.
CPC ..... *G10L 21/0232* (2013.01); *G10L 25/51* (2013.01); *H04R 1/04* (2013.01);
(Continued)

(58) Field of Classification Search
CPC ..... H04R 3/005; H04R 3/00; H04R 1/406; H04R 1/04; H04R 1/005; H04R 1/083;
(Continued)

(56) References Cited

U.S. PATENT DOCUMENTS

2007/0047744 A1* 3/2007 Harney ..... H04M 1/19 381/113
2008/0049953 A1 2/2008 Harney et al.
(Continued)

FOREIGN PATENT DOCUMENTS

CN 105848075 A * 8/2016 ..... B81B 7/02
JP 2013251774 A 12/2013
(Continued)

OTHER PUBLICATIONS

ISA/KR, International Search Report and Written Opinion of the International Searching Authority, International Application No. PCT/KR2018/011734, dated Feb. 20, 2019, 13 pages.
(Continued)

*Primary Examiner* — Ahmad F. Matar
*Assistant Examiner* — Sabrina Diaz

(57) ABSTRACT

Various embodiments of the present invention relate to a microphone, an electronic apparatus including the microphone and a method for controlling the microphone, the electronic apparatus comprising: a substrate comprising a first hole and a second hole into which an audio signal is input; a case that has a resonance space formed thereinside as a first side thereof is opened, a second side thereof is closed, and the first side is coupled with the substrate; a first audio generation unit that converts an audio signal input through a first hole of the substrate into an electrical signal, and comprises a first plate and a first membrane spaced apart from each other; a second audio generation unit that con-
(Continued)

verts an audio signal input through a second hole of the substrate into an electrical signal, and comprises a second plate and a second membrane spaced apart from each other; a sound insulation wall that is disposed between the first audio generation unit and the second audio generation unit, and separates spaces of the first audio generation unit and the second audio generation unit as a first side thereof is coupled with the case and the second side thereof is coupled with the substrate; a microphone that is electrically connected to the first audio generation unit and the second audio generation unit, and comprises a signal processing unit for removing a noise signal exceeding a threshold value by analyzing the audio signals transmitted through the first audio generation unit and the second audio generation unit; and a processor that is electrically coupled with the microphone, wherein the sensitivity of the first audio generation unit is configured to be lower than the sensitivity of the second audio generation unit, so that the microphone can correctly receive the user's audio command by removing noise greater than or equal to a predetermined level. Various embodiments other than the various embodiments disclosed in the present invention are possible.

15 Claims, 9 Drawing Sheets

(51) Int. Cl.

| | |
|---|---|
| ***H04R 1/04*** | (2006.01) |
| ***H04R 1/28*** | (2006.01) |
| ***H04R 1/40*** | (2006.01) |
| ***H04R 3/00*** | (2006.01) |
| ***H04R 19/04*** | (2006.01) |
| ***H04R 29/00*** | (2006.01) |
| *G10L 21/0216* | (2013.01) |

(52) U.S. Cl.
CPC ..... *H04R 1/2876* (2013.01); *H04R 1/406* (2013.01); *H04R 3/005* (2013.01); *H04R 19/04* (2013.01); *H04R 29/005* (2013.01); *G10L 2021/02165* (2013.01); *H04R 2410/01* (2013.01)

(58) Field of Classification Search
CPC ..... H04R 1/086; H04R 1/2876; H04R 2201/401; H04R 2201/403; H04R 25/00; H04R 25/407; H04R 23/004; H04R 19/04; H04R 19/016; H04R 19/005; H04R 19/00; H04R 29/005; H04R 2410/01; G10L 21/0232; G10L 25/51; G10L 2021/02165
USPC ..... 381/92, 94.1, 111, 113, 369, 174
See application file for complete search history.

(56) References Cited

U.S. PATENT DOCUMENTS

| | | | | |
|---|---|---|---|---|
| 2010/0183167 | A1* | 7/2010 | Phelps | H04M 1/6008 381/94.1 |
| 2010/0226507 | A1* | 9/2010 | Horibe | H04R 1/406 381/92 |
| 2012/0250897 | A1 | 10/2012 | Michel et al. | |
| 2014/0211957 | A1* | 7/2014 | Bolognia | H04R 3/002 381/74 |
| 2014/0355784 | A1* | 12/2014 | Han | H04R 1/406 381/92 |
| 2015/0010191 | A1* | 1/2015 | Baumhauer, Jr. | H04R 1/04 381/355 |
| 2015/0104048 | A1 | 4/2015 | Uchida et al. | |
| 2015/0125003 | A1 | 5/2015 | Wiesbauer et al. | |
| 2016/0167946 | A1* | 6/2016 | Jenkins | H04R 19/04 257/416 |
| 2016/0345106 | A1* | 11/2016 | Pahl | H04R 19/04 |

FOREIGN PATENT DOCUMENTS

| | | | |
|---|---|---|---|
| KR | 10-1998-0082538 | A | 12/1998 |
| KR | 10-2011-0106935 | A | 9/2011 |
| KR | 10-2014-0140292 | A | 12/2014 |
| KR | 10-2016-0127326 | A | 11/2016 |
| WO | 2008014324 | A2 | 1/2008 |

OTHER PUBLICATIONS

Supplementary European Search Report dated Oct. 1, 2020 in connection with European Application No. 18865648.2, 8 pages.
Korean Intellectual Property Office, "Office Action" dated Jul. 19, 2021, in connection with Korean Patent Application No. 10-2017-0132307, 16 pages.

* cited by examiner

MICROPHONE, ELECTRONIC APPARATUS INCLUDING MICROPHONE AND METHOD FOR CONTROLLING ELECTRONIC APPARATUS

CROSS-REFERENCE TO RELATED APPLICATIONS

This application is a 371 National Stage of International Application No. PCT/KR2018/011734, filed Oct. 4, 2018, which claims priority to Korean Patent Application No. 10-2017-0132307, filed Oct. 12, 2017, the disclosures of which are herein incorporated by reference in their entirety.

BACKGROUND

1. Field

Various embodiments of the disclosure relate to a microphone, an electronic device including the microphone and a method of controlling the electronic device.

2. Description of Related Art

An electronic device, such as a smartphone, television (TV), a vehicle, a washing machine, a refrigerator or a drone, may be equipped with a microphone for converting an audio command from a user into an electrical signal.

When the microphone receives an audio command from a user, the electronic device may perform a corresponding function.

A very small microphone is recently developed using a micro electro mechanical system (MEMS) technology.

SUMMARY

In order for an electronic device to be capable of performing a corresponding function in response to an audio command from a user, a microphone needs to be capable of accurately receive an audio command from a user regardless of a user's location and a surrounding environment.

However, if there is a lot of noise around the electronic device or loud noise occurs in the electronic device itself, the microphone may not receive an audio command from a user because clipping occurs in the microphone itself. That is, when an audio signal of a given level or more is input to the microphone, the microphone may not receive an audio command from a user because saturation occurs in the microphone.

For example, an electronic device in which loud noise basically occurs, such as TV, a vehicle, a washing machine or a vacuum cleaner, may not perform a function according to an audio command from a user.

Various embodiments of the disclosure may provide a microphone capable of accurately receiving an audio command from a user although noise of a given level or more occurs in an electronic device, an electronic device including the microphone and a method of controlling the electronic device.

According to the disclosure, an electronic device includes a substrate including a first hole and second hole to which audio signals are input; a microphone including a casing having a first side open and a second side closed, wherein the first side is coupled to the substrate to form a resonant space within the casing, a first audio generator configured to convert an audio signal, input through the first hole of the substrate, into an electrical signal, wherein the first audio generator includes a first plate and first membrane spaced apart from each other, a second audio generator configured to convert an audio signal, input through the second hole of the substrate, into an electrical signal, wherein the second audio generator includes a second plate and second membrane spaced apart from each other, a noise barrier positioned between the first audio generator and the second audio generator, wherein the noise barrier has a first side coupled to the casing and a second side coupled to the substrate and separates the spaces of the first audio generator and the second audio generator, and a signal processor electrically connected to the first audio generator and the second audio generator and configured to analyze audio signals transmitted by the first audio generator and the second audio generator and to remove a noise signal exceeding a threshold; and a processor electrically connected to the microphone, wherein the sensitivity of the first audio generator may be smaller than the sensitivity of the second audio generator.

According to the disclosure, a microphone includes a casing having a first side open and a second side closed, wherein the first side is coupled to a substrate including a first hole and second hole to which audio signals are input and forms a resonant space within the casing; a first audio generator configured to convert an audio signal, input through the first hole of the substrate, into an electrical signal, wherein the first audio generator includes a first plate and first membrane spaced apart from each other, a second audio generator configured to convert an audio signal, input through the second hole of the substrate, into an electrical signal, wherein the second audio generator includes a second plate and second membrane spaced apart from each other, a noise barrier positioned between the first audio generator and the second audio generator, wherein the noise barrier has a first side coupled to the casing and a second side coupled to the substrate and separates the spaces of the first audio generator and the second audio generator, and a signal processor electrically connected to the first audio generator and the second audio generator and configured to analyze audio signals transmitted by the first audio generator and the second audio generator and to remove a noise signal exceeding a threshold; wherein the sensitivity of the first audio generator may be smaller than the sensitivity of the second audio generator.

According to the disclosure, a method of controlling an electronic device including a microphone may include receiving, by a first audio generator and a second audio generator, audio signals through a first hole and second hole formed in a substrate; detecting, by a signal processor, a signal exceeding a threshold in the audio signals transmitted by the first audio generator and the second audio generator; amplifying, by the signal processor, an audio signal exceeding the threshold when the audio signal input through the first audio generator exceeds the threshold; inverting, by the signal processor, the amplified audio signal; transmitting, by the signal processor, the inverted audio signal to the second audio generator; and removing, by the signal processor, an audio signal exceeding the threshold by controlling a movement of the second audio generator to a given level.

According to various embodiments of the disclosure, when noise of a given level or more and an audio command from a user are input to the microphone, the noise of a given level or more (e.g., clipping signal) is removed through the first audio generator, the second audio generator and the delay plate provided in the microphone. Accordingly, the microphone can accurately receive the audio command from the user, and the electronic device can perform a corresponding function.

DETAILED DESCRIPTION

Figure 1:
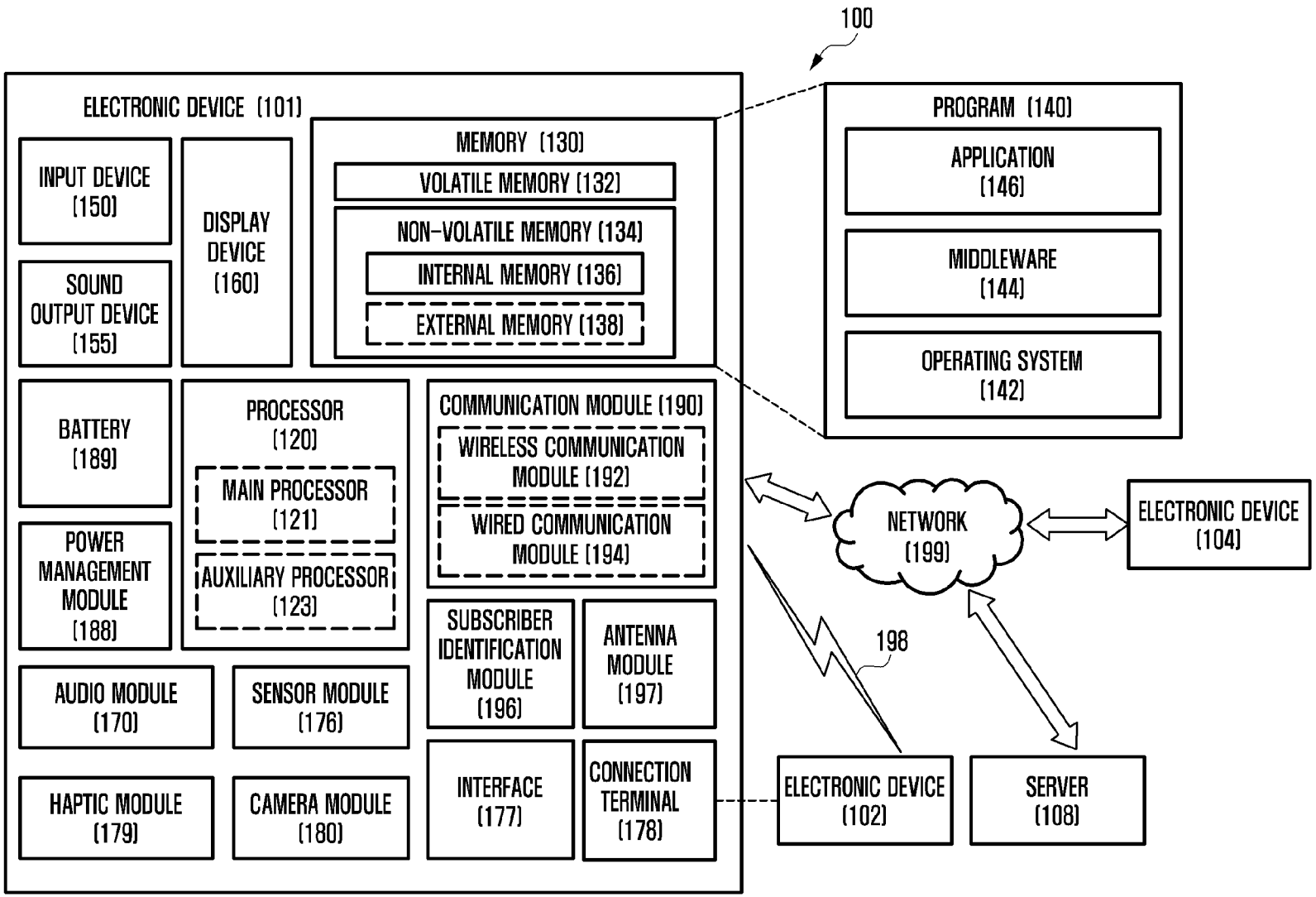
FIG. 1 is a block diagram of an electronic device within a network environment according to various embodiments of the disclosure.

FIG. 1 is a block diagram illustrating an electronic device 101 in a network environment 100 according to certain embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform certain data processing or computation. According to an embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. The memory 130 may store certain data used by at least one component (e.g., the processor 120 or the sensor module 176) of the electronic device 101. The certain data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These certain types of communication modules may be implemented as a single component (e.g., a single chip), or may be implemented as multi components (e.g., multi chips) separate from each other.

The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit/receive a signal or power to/from an external entity (e.g., an external electronic device). According to some embodiments, the antenna module 197 may be formed of a conductor or a conductive pattern and may further include any other component (e.g., RFIC). According to an embodiment, the antenna module 197 may include one or more antennas, which may be selected to be suitable for a communication scheme used in a specific communication network, such as the first network 198 or the second network 199 by, for example, the communication module 190. Through the selected at least one antenna, a signal or power may be transmitted or received between the communication module 190 and the external electronic device.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
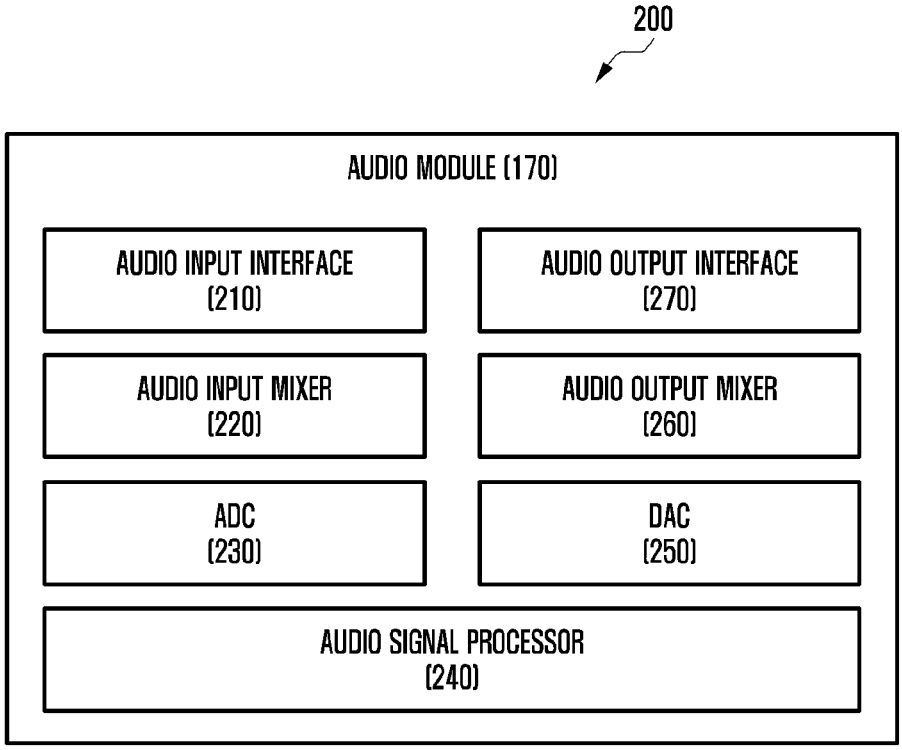
FIG. 2 is a block diagram of an audio module according to various embodiments of the disclosure.

FIG. 2 is a block diagram 200 illustrating the audio module 170 according to various embodiments. Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal inputted via the audio input interface 210 or an audio signal that is to be outputted via the audio output interface 270. According to an embodiment, the audio amplifier may be configured as a module separate from the audio module 170.

The electronic device according to certain embodiments may be one of certain types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include certain changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise.

As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Figure 3:
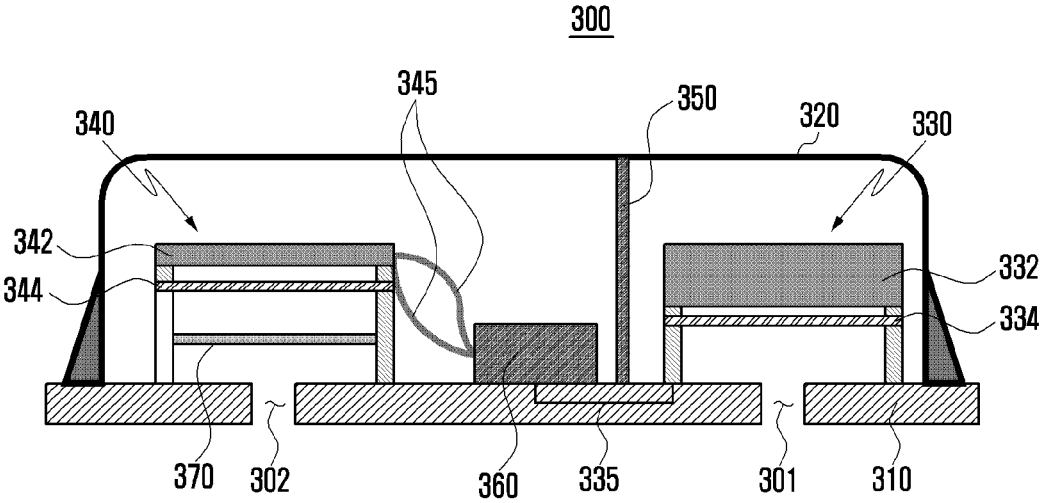
FIG. 3 is a diagram illustrating the configuration of a microphone according to a first embodiment of the disclosure.

FIG. 3 is a diagram illustrating the configuration of a microphone according to a first embodiment of the disclosure.

Referring to FIG. 3, the microphone 300 according to the first embodiment of the disclosure may include a substrate 310, a casing 320, a first audio generator 330, a second audio generator 340, a noise barrier 350, a signal processor 360 and a delay plate 370.

The substrate 310 may be provided in an electronic device (e.g., the electronic device 101 in FIG. 1). The substrate 310 may include a first hole 301 and second hole 302 to which an audio signal from the outside is input. The first hole 301 and the second hole 302 may be formed to perpendicularly penetrate the substrate 310. Audio signals input through the first hole 301 and the second hole 302 may be transmitted to the first audio generator 330 and the second audio generator 340, respectively. The first hole 301 and the second hole 302 may be spaced apart from each other at a given interval. The substrate 310 may include a printed circuit board (PCB) or a flexible printed circuit board (FPCB). According to one embodiment, an audio signal input through the first hole 301 and the second hole 302 may be a user command from the user of an electronic device (e.g., the electronic device 101 in FIG. 1), which is delivered through a voice.

The casing 320 may have a first side (e.g., top) open and a second side (e.g., bottom) closed. The casing 320 can protect elements, such as the first audio generator 330, the second audio generator 340, the signal processor 360 and the delay plate 370, by surrounding the elements. The casing 320 may have the first side coupled to the substrate 310 to form a resonant space therein. The casing 320 may be made of metal or a ceramic material.

The first audio generator 330 may be connected to the signal processor 360 through a wire 335. The first audio generator 330 may convert an audio signal, input through the first hole 301 of the substrate 310, into an electrical signal. According to one embodiment, the first audio generator 330 may generate a first audio output signal in response to an audio command from a user input through the first hole 301 of the substrate 310, and may transmit the generated first audio output signal to the signal processor 360 through the wire 335.

According to various embodiments, the first audio generator 330 may include a first plate 332 (e.g., fixing film) and a first membrane 334 (e.g., vibration film). The first audio generator 330 may be positioned on the substrate 310 near the first hole 301. The first membrane 334 may be exposed by the first hole 301. The first plate 332 and the first membrane 334 may be spaced apart from each other at a given interval. The first plate 332 and the first membrane 334 may include a plurality of holes (e.g., holes 375 in FIG. 4) so that an audio signal input through the first hole 301 can pass through the first plate 332 and the first membrane 334. According to one embodiment, the first plate 332 may be fixed, and the first membrane 334 may be flexible in such a way as to generate vibration. For example, when an audio signal is input through the first hole 301 of the substrate 310, the first membrane 334 may vibrate. When the first membrane 334 vibrates, an interval between the first plate 332 and the first membrane 334 may be changed. In response to the change, capacitance between the first plate 332 and the first membrane 334 is changed. The changed capacitance may be converted into an electrical signal. The first plate 332 may include a first MEMS back plate, and the first membrane 334 may include a first MEMS membrane.

The second audio generator 340 may be connected to the signal processor 360 through a connection line 345. The second audio generator 340 may convert an audio signal, input through the second hole 302 of the substrate 310, into an electrical signal. According to one embodiment, the second audio generator 340 may generate a second audio output signal in response to an audio command from a user input through the second hole 302 of the substrate 310, and may transmit the generated second audio output signal to the signal processor 360 through the connection line 345.

According to various embodiments, the second audio generator 340 may include a second plate 342 (e.g., fixing film) and a second membrane 344 (e.g., vibration film). The second audio generator 340 may be positioned on the substrate 310 near the second hole 302. The second plate 342 and the second membrane 344 may be spaced apart from each other at a given interval. The second plate 342 and the second membrane 344 may include a plurality of holes (e.g., the holes 375 in FIG. 4) so that an audio signal input through the second hole 302 can pass through the second plate 342 and the second membrane 344. According to one embodiment, the second plate 342 may be fixed, and the second membrane 344 may be flexible in such a way as to generate vibration. For example, when an audio signal is input through the second hole 302 of the substrate 310, the second membrane 344 may vibrate. When the second membrane 344 vibrates, an interval between the second plate 342 and the second membrane 344 may be changed. In response to the change, capacitance between the second plate 342 and the second membrane 344 is changed. The changed capacitance may be converted into an electrical signal. The second plate 342 may include a second MEMS back plate, and the second membrane 344 may include a second MEMS membrane.

According to one embodiment, when an electric current is supplied from the signal processor 360, vibration may occur because electric charges are generated between the second plate 342 and second membrane 344 of the second audio generator 340. In response to the vibration, capacitance between the second plate 342 and the second membrane 344 is changed. The changed capacitance may be converted into an electrical signal.

According to various embodiments, the first audio generator 330 and the second audio generator 340 may be disposed at locations corresponding to the first hole 301 and second hole 302 of the substrate 310. The first audio generator 330 and the second audio generator 340 may be spaced apart from each other at a given interval. The first plate 332 may be thicker than the second plate 342. The first plate 332 may have relatively lower sensitivity than the second plate 342. The second plate 342 may have relatively higher sensitivity than the first plate 332. For example, the sensitivity of the first plate 332 may be −42 dB, and the sensitivity of the second plate 342 may be −30 dB. Saturation may not easily occur in the first plate 332 because the first plate 332 has relatively lower sensitivity than the second plate 342. The second plate 342 may accommodate a small audio signal because the second plate has relatively higher sensitivity than the first plate 332.

The noise barrier 350 may be positioned between the first audio generator 330 and the second audio generator 340. The noise barrier 350 may have a first side (e.g., top) coupled to the casing 350 and a second side (e.g., bottom) coupled to the substrate 310. The noise barrier 350 may separate the spaces of the first audio generator 330 and the second audio generator 340. The noise barrier 350 can prevent interference from occurring between a first audio output signal generated by the first audio generator 330 and a second audio output signal generated by the second audio generator 340.

The signal processor 360 may be positioned on the substrate 310. The signal processor 360 may be positioned adjacent to the second audio generator 340. The signal processor 360 may be electrically connected to the first audio generator 330 through the wire 335. The signal processor 360 may be electrically connected to the second audio generator 340 through the connection line 345. The signal processor 360 may supply power to the first audio generator 330 and the second audio generator 340. The signal processor 360 may process audio signals transmitted by the first audio generator 330 and the second audio generator 340. The signal processor 360 may compose a first audio output signal and second audio output signal transmitted by the first audio generator 330 and the second audio generator 340. The signal processor 360 may analyze audio signals input through the first hole 301 and second hole 302 of the substrate 310, and may remove a noise signal (e.g., loud noise) of a threshold or more. The signal processor 360 may output, to an electronic device (e.g., the electronic device 101 in FIG. 1), an audio command from a user, from which a noise signal of a threshold or more has been removed. The signal processor 360 may include an application specific integrated circuit (ASIC). For example, the signal processor 360 may include the audio signal processor 240 disclosed in FIG. 2.

The delay plate 370 may be included in the second audio generator 340. The delay plate 370 may be exposed by the second hole 302 of the substrate 310. The delay plate 370 may be positioned between the second membrane 344 and the substrate 310. The delay plate 370 can prevent saturation from occurring in the microphone 300 by delaying the time taken for an audio signal, input through the second hole 302 of the substrate 310, to reach the second membrane 344 of the second audio generator 340. The delay plate 370 may delay the phase of an audio signal, input to the second membrane 344, compared to the first membrane 334. The delay plate 370 may be a phase-delayed filter or a phase-delayed mesh. The delay plate 370 may be made of metal or fabric.

Figure 4:
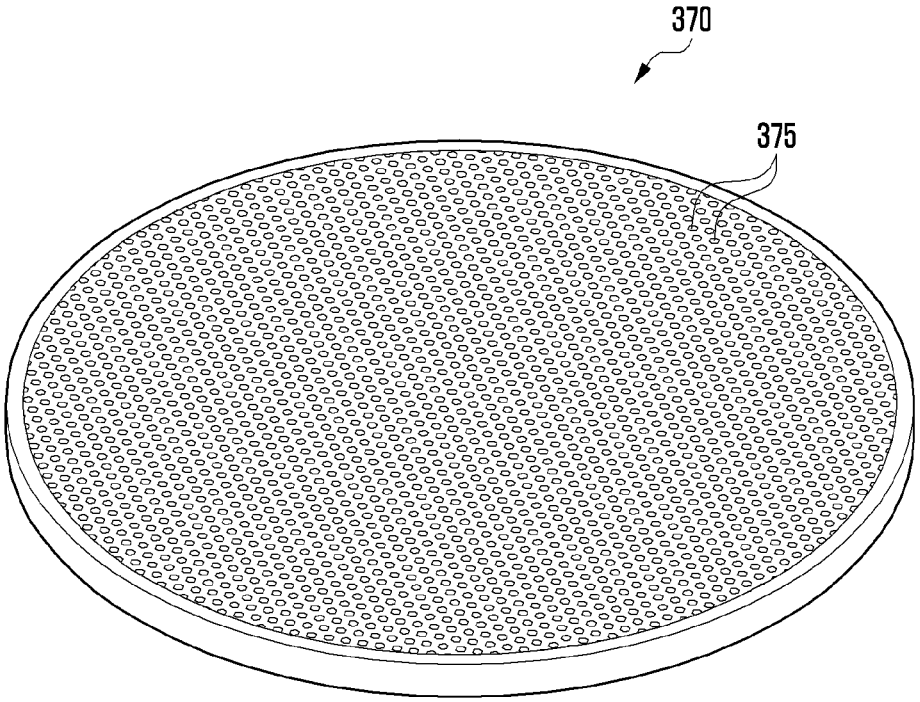
FIG. 4 is a diagram illustrating the configuration of a delay plate according to various embodiments of the disclosure.

FIG. 4 is a diagram illustrating the configuration of a delay plate according to various embodiments of the disclosure.

Referring to FIG. 4, the delay plate 370 according to various embodiments of the disclosure may include the plurality of holes 375. The sizes of the holes 375 may be different. The phase delay rate of an audio signal in the delay plate 370 may be different depending on the sizes of the holes 375.

According to various embodiments, the same holes as the holes 375 formed in the delay plate 370 may be formed in the first plate 332 and first membrane 334 of the first audio generator 330 and the second plate 342 and second membrane 344 of the second audio generator 340. According to one embodiment, the sensitivity of an audio signal may different depending on the number, pattern, etc. of the holes 375 formed in the first plate 332 and first membrane 334 of the first audio generator 330 and the second plate 342 and second membrane 344 of the second audio generator 340. For example, the sensitivity may be higher as the size of the hole 375 is smaller, and the sensitivity may be lower as the size of the hole 375 is greater.

Figure 5:
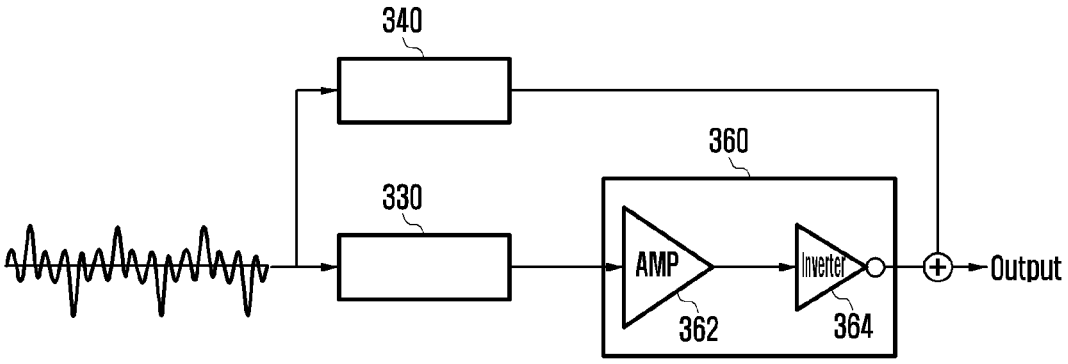
FIG. 5 is a diagram describing the configuration and operation of a signal processor according to various embodiments of the disclosure.

FIG. 5 is a diagram describing the configuration and operation of the signal processor according to various embodiments of the disclosure.

Referring to FIG. 5, the signal processor 360 according to various embodiments of the disclosure may include an amplifier 362 and an inverter 364.

The amplifier 362 may amplify audio signals input through the first hole 301 and second hole 302 of the substrate 310. The inverter 364 may invert the signals amplified through the amplifier 362.

According to various embodiments, the first audio generator 330 and the second audio generator 340 may receive audio signals through the first hole 301 and second hole 302 of the substrate 310. The audio signal may include an audio command from a user or noise of a threshold.

For example, if an audio signal exceeding a preset threshold is input to the first audio generator 330 including the first plate 332 thicker than the second plate 342 of the second audio generator 340 and an audio command from a user is input to the second audio generator 340, the audio signal of the first audio generator 330 that exceeds the threshold may be transmitted to the signal processor 360.

The audio signal transmitted to the signal processor 360 may be amplified through the amplifier 362 by a gain difference (e.g., 12 dB) between the first audio generator 330 and the second audio generator 340.

The signal amplified through the amplifier 362 may be inverted through the inverter 364 and transmitted to the second audio generator 340. The second audio generator 340 may output the signal from the signal processor 360 by controlling a noise signal that belongs to the signal and that may cause saturation to a given level.

According to one embodiment, the signal processor 360 may compose the audio signal of the second audio generator 340 and a signal inverted through the inverter 364. The signal inverted through the inverter 364 has a phase opposite the phase of the audio signal of the second audio generator 340. Accordingly, when the signal of the first audio generator 340 and the audio signal of the second audio generator 340 are composed, the signal of the first audio generator 330 can be removed.

Figure 6:
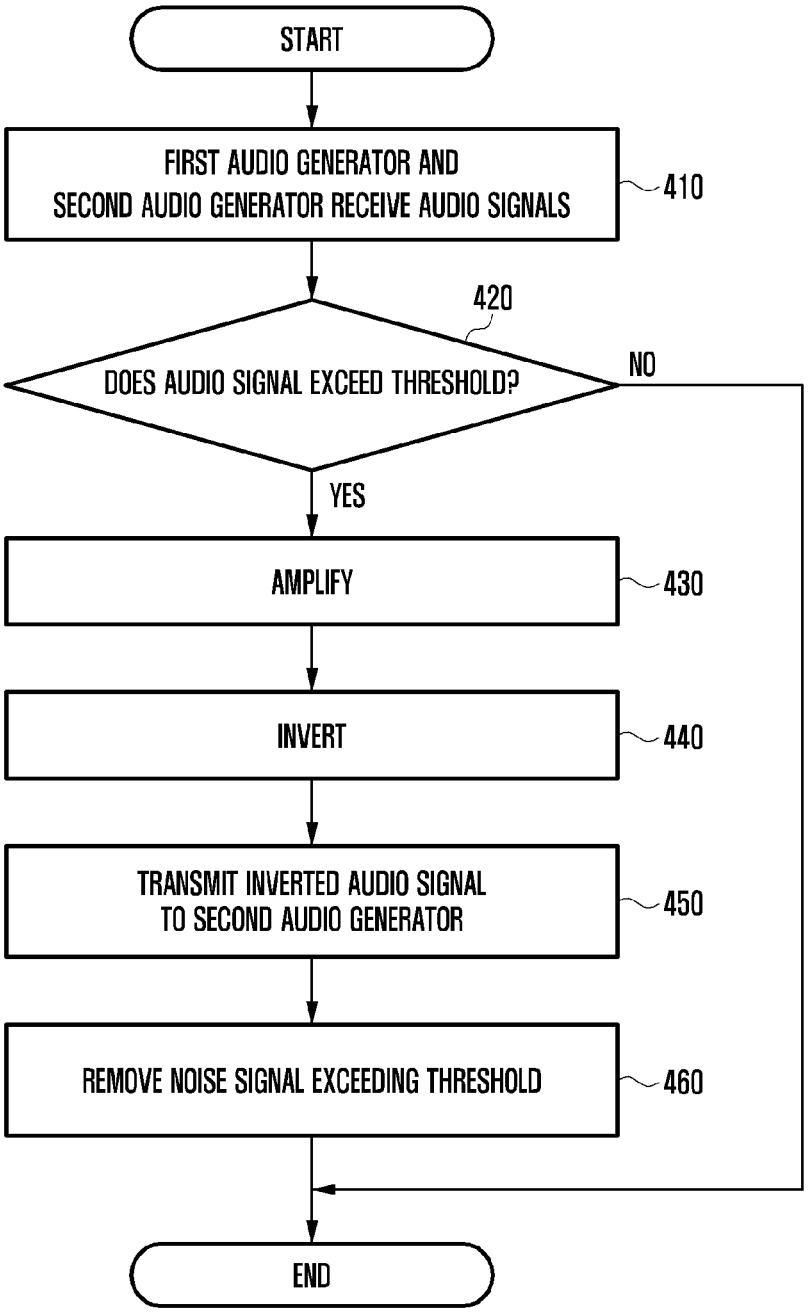
FIG. 6 is a flowchart illustrating a method of controlling the microphone according to various embodiments of the disclosure.

FIG. 6 is a flowchart illustrating a method of controlling the microphone according to various embodiments of the disclosure.

FIG. 6 may be an operation of the signal processor if the first plate 332 of the first audio generator 330 is thicker than the second plate 342 of the second audio generator 340. That is, the first plate 332 may have relatively lower sensitivity than the second plate 342. For example, the sensitivity of the first plate 332 may be −42 dB, and the sensitivity of the second plate 342 may be −30 dB.

First, at operation 410, the first audio generator 330 and the second audio generator 340 may receive audio signals through the first hole 301 and second hole 302 of the substrate 310.

At operation 420, the signal processor 360 may detect and determine which one of the audio signals of the first audio generator 330 and the second audio generator 340 exceeds a threshold.

At operation 430, if the audio signal received through the first audio generator 330 exceeds the threshold, the signal processor 360 may amplify the audio signal exceeding the threshold through the amplifier 362.

At operation 440, the signal processor 360 may invert the audio signal, amplified at operation 430, through the inverter 364.

At operation 450, the signal processor 360 may transmit the audio signal, inverted at operation 440, to the second audio generator 340.

At operation 460, the signal processor 360 may remove a noise signal (e.g., a signal exceeding the threshold) which may cause saturation from the audio signal, received from the second audio generator 340, by controlling a movement of the second membrane 344 of the second audio generator 340 to a given level simultaneously with operation 450, and may output a corresponding signal.

Figure 7:
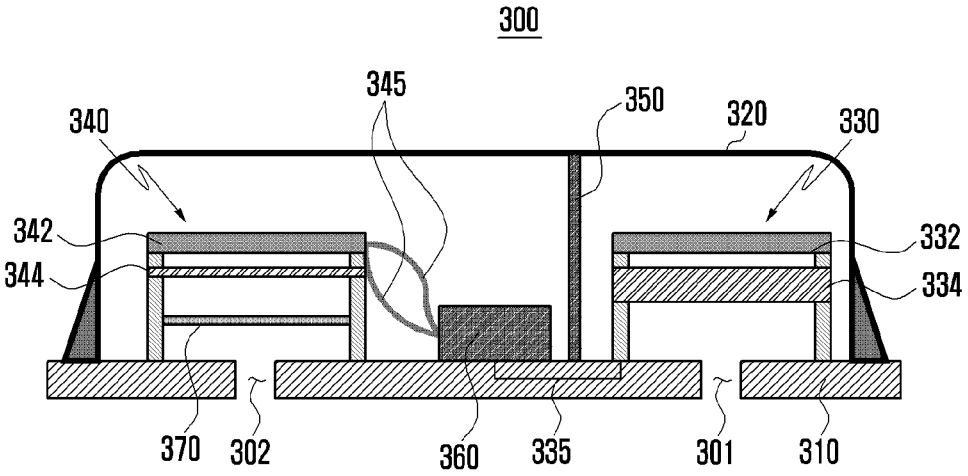
FIG. 7 is a diagram illustrating the configuration of a microphone according to a second embodiment of the disclosure.

FIG. 7 is a diagram illustrating the configuration of a microphone according to a second embodiment of the disclosure.

Referring to FIG. 7, the microphone 300 according to the second embodiment of the disclosure may include a substrate 310, a casing 320, a first audio generator 330, a second audio generator 340, a noise barrier 350, a signal processor 360 and a delay plate 370.

The first audio generator 330 may include a first plate 332 and a first membrane 334. The second audio generator 340 may include a second plate 342 and a second membrane 344.

In the microphone 300 disclosed in FIG. 7, only the configurations and functions of the first membrane 334 and the second membrane 344 may be different, but the locations, functions and operations of the remaining elements may be the same compared to the microphone 300 disclosed in FIG. 3.

Referring to FIG. 7, the thickness of the first membrane 334 may be thicker than the thickness of the second membrane 344 (e.g., approximately twice).

According to various embodiments, the first membrane 334 may have relatively lower sensitivity than the second membrane 344. For example, the sensitivity of the first membrane 334 may be −36 dB, and the sensitivity of the second membrane 344 may be −30 dB. A difference between the sensitivities of the first membrane 334 and the second membrane 344 may be 6 dB. Saturation may not easily occur in the microphone 300 because the first membrane 334 has relatively lower sensitivity than the second membrane 344. The second membrane 344 may accommodate a small audio signal because the second membrane has relatively higher sensitivity than the first membrane 334.

Figure 8:
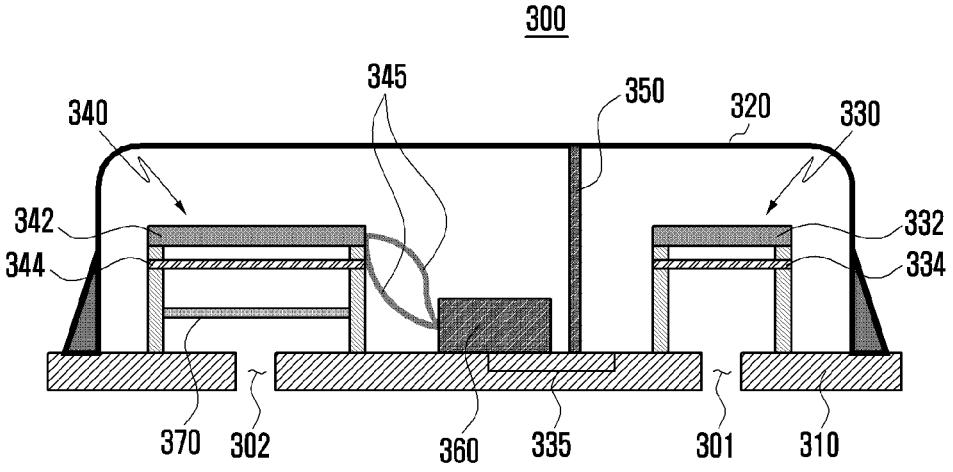
FIG. 8 is a diagram illustrating the configuration of a microphone according to a third embodiment of the disclosure.

FIG. 8 is a diagram illustrating the configuration of a microphone according to a third embodiment of the disclosure.

Referring to FIG. 8, the microphone 300 according to the third embodiment of the disclosure may include a substrate 310, a casing 320, a first audio generator 330, a second audio generator 340, a noise barrier 350, a signal processor 360 and a delay plate 370.

The first audio generator 330 may include a first plate 332 and a first membrane 334. The second audio generator 340 may include a second plate 342 and a second membrane 344.

In the microphone 300 disclosed in FIG. 8, only the configurations and functions of the first audio generator 330 and the second audio generator 340 may be different, but the locations, functions and operations of the remaining elements may be the same compared to the microphone 300 disclosed in FIG. 3.

Referring to FIG. 8, the area (e.g., width) of the first audio generator 330 may be smaller than the area (e.g., approximately twice) of the second audio generator 340.

According to various embodiments, the first audio generator 330 may have relatively lower sensitivity than the second audio generator 340. For example, the sensitivity of the first audio generator 330 may be −36 dB, and the sensitivity of the second audio generator 340 may be −30 dB. A difference between the sensitivities of the first audio generator 330 and the second audio generator 340 may be 6 dB. Saturation may not easily occur in the microphone 300 because the first audio generator 330 has relatively lower sensitivity than the second audio generator 340. The second audio generator 340 can accommodate a small audio signal because the second audio generator has relatively higher sensitivity than the first audio generator 330.

Figure 9:
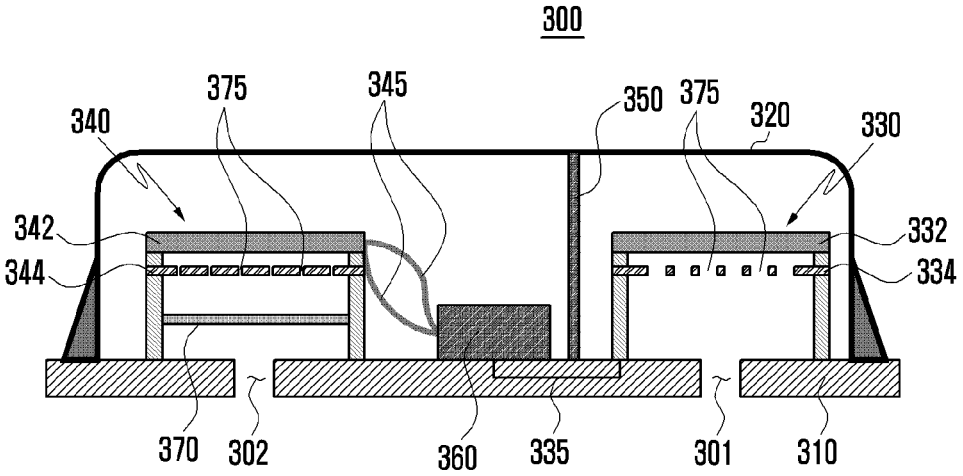
FIG. 9 is a diagram illustrating the configuration of a microphone according to a fourth embodiment of the disclosure.

FIG. 9 is a diagram illustrating the configuration of a microphone according to a fourth embodiment of the disclosure.

Referring to FIG. 9, the microphone 300 according to the fourth embodiment of the disclosure may include a substrate 310, a casing 320, a first audio generator 330, a second audio generator 340, a noise barrier 350, a signal processor 360 and a delay plate 370.

The first audio generator 330 may include a first plate 332 and a first membrane 334. The second audio generator 340 may include a second plate 342 and a second membrane 344.

In the microphone 300 disclosed in FIG. 9, only the first membrane 334 and the second membrane 344 may be different, but the locations, functions and operations of the remaining elements may be the same compared to the microphone 300 disclosed in FIG. 3.

Referring to FIG. 9, the first membrane 334 of the first audio generator 330 and the second membrane 344 of the second audio generator 340 may include the plurality of holes 375. The sensitivity of an audio signal may be different depending on the number, pattern, etc. of the holes 375 formed in the first membrane 334 and the second membrane 344. For example, the sensitivity may be higher as the size of the hole 375 is smaller, and the sensitivity may be lower as the size of the hole 375 is greater. The size of the hole 375 formed in the first membrane 334 may be greater than the size (e.g., approximately twice) of the hole 375 formed in the second membrane 344.

According to various embodiments, the first membrane 334 may have relatively lower sensitivity than the second membrane 344. For example, the sensitivity of the first membrane 334 may be −36 dB, and the sensitivity of the second membrane 344 may be −30 dB. A difference between the sensitivities of the first membrane 334 and the second membrane 344 may be 6 dB. Saturation may not easily occur in the microphone 300 because the first membrane 334 has relatively lower sensitivity than the second membrane 344. The second membrane 344 can accommodate a small audio signal because the second membrane has relatively higher sensitivity than the first membrane 334.

According to various embodiments, an electronic device (e.g., the electronic device 101 in FIG. 1), such as a smartphone, television (TV), a vehicle, a washing machine, a refrigerator, a wearable device or a drone, may include the microphone configured as described above.

While the disclosure has been described in detail with reference to specific embodiments, it is to be understood that various changes and modifications may be made without departing from the scope of the disclosure. Therefore, the scope of the disclosure should not be limited by embodiments described herein, but should be determined by the scope of the appended claims.

The invention claimed is:

1. An electronic device, comprising:

a substrate comprising a first hole and second hole to which audio signals are input;

a microphone comprising:

a casing having a first side open and a second side closed, wherein the first side is coupled to the substrate to form a resonant space within the casing;

a first audio generator configured to convert an audio signal, input through the first hole of the substrate, into an electrical signal, wherein the first audio generator comprises a first plate and first membrane spaced apart from each other;

a second audio generator configured to convert an audio signal, input through the second hole of the substrate, into an electrical signal, wherein the second audio generator comprises a second plate and second membrane spaced apart from each other, wherein a delay plate delaying a time taken for an audio signal, input through the second hole, to reach the second membrane is positioned between the second membrane and the second hole;

a noise barrier positioned between the first audio generator and the second audio generator, wherein the noise barrier has a first side coupled to the casing and a second side coupled to the substrate and separates spaces of the first audio generator and the second audio generator; and a signal processor electrically connected to the first audio generator and the second audio generator and configured to invert audio signals transmitted by the first audio generator and transmit the inverted audio signals to the second audio generator to remove a noise signal exceeding a threshold; and a processor electrically connected to the microphone, wherein a sensitivity of the first audio generator is smaller than a sensitivity of the second audio generator.

2. The electronic device of claim 1, wherein:

the first plate is thicker than the second plate, and the first membrane is thicker than the second membrane.

3. The electronic device of claim 1, wherein:

the first plate is fixed, and the first membrane is flexible in such a way as to generate vibration through an audio signal input the first hole, and the second plate is fixed, and the second membrane is flexible in such a way as to generate vibration through an audio signal input the second hole.

4. The electronic device of claim 1, wherein:

the first plate and the first membrane comprise a plurality of holes so that an audio signal input through the first hole passes through the first plate and the first membrane, and the second plate and the second membrane comprise a plurality of holes so that an audio signal input through the second hole passes through the second plate and the second membrane, and a size of the hole formed in the first membrane is greater than a size of the hole formed in the second membrane.

5. The electronic device of claim 1, wherein the delay plate comprises a plurality of holes so that an audio signal input through the second hole passes through the delay plate.

6. The electronic device of claim 1, wherein the signal processor comprises:

an amplifier configured to amplify the noise signal transmitted by the first audio generator and exceeding the threshold.

7. The electronic device of claim 1, wherein an area of the first audio generator is smaller than an area of the second audio generator.

8. A microphone, comprising:

a casing having a first side open and a second side closed, wherein the first side is coupled to a substrate comprising a first hole and second hole to which audio signals are input and forms a resonant space within the casing;

a first audio generator configured to convert an audio signal, input through the first hole of the substrate, into an electrical signal, wherein the first audio generator comprises a first plate and first membrane spaced apart from each other;

a second audio generator configured to convert an audio signal, input through the second hole of the substrate, into an electrical signal, wherein the second audio generator comprises a second plate and second membrane spaced apart from each other, wherein a delay plate delaying a time taken for an audio signal, input through the second hole, to reach the second membrane is positioned between the second membrane and the second hole;

a noise barrier positioned between the first audio generator and the second audio generator, wherein the noise barrier has a first side coupled to the casing and a second side coupled to the substrate and separates spaces of the first audio generator and the second audio generator; and a signal processor electrically connected to the first audio generator and the second audio generator and configured to invert audio signals transmitted by the first audio generator and transmit the inverted audio signals to the second audio generator to remove a noise signal exceeding a threshold, wherein a sensitivity of the first audio generator is smaller than a sensitivity of the second audio generator.

9. The microphone of claim 8, wherein the first plate is thicker than the second plate.

10. The microphone of claim 8, wherein:

the first plate is fixed, and the first membrane is flexible in such a way as to generate vibration through an audio signal input the first hole, and the second plate is fixed, and the second membrane is flexible in such a way as to generate vibration through an audio signal input the second hole.

11. The microphone of claim 8, wherein:

the first plate and the first membrane comprise a plurality of holes so that an audio signal input through the first hole passes through the first plate and the first membrane, and the second plate and the second membrane comprise a plurality of holes so that an audio signal input through the second hole passes through the second plate and the second membrane, and a size of the hole formed in the first membrane is greater than a size of the hole formed in the second membrane.

12. The microphone of claim 8, wherein:

the delay plate comprises a plurality of holes so that an audio signal input through the second hole passes through the delay plate.

13. The microphone of claim 8, wherein the first membrane is thicker than the second membrane.

14. The microphone of claim 8, wherein an area of the first audio generator is smaller than an area of the second audio generator.

15. A method of controlling an electronic device including a microphone, the method comprising:

receiving, by a first audio generator and a second audio generator, audio signals through a first hole and second hole formed in a substrate, wherein a signal received through the second hole passes through a delay plate delaying a time taken for the audio signal, input through the second hole, to reach the second audio generator;

detecting, by a signal processor, a signal exceeding a threshold in the audio signals transmitted by the first audio generator and the second audio generator;

amplifying, by the signal processor, an audio signal exceeding the threshold when an audio signal input through the first audio generator exceeds the threshold;

inverting, by the signal processor, the amplified audio signal;

transmitting, by the signal processor, the inverted amplified audio signal to the second audio generator; and removing, by the signal processor, an audio signal exceeding the threshold by controlling a movement of the second audio generator to a given level, wherein a sensitivity of the first audio generator is smaller than a sensitivity of the second audio generator.

* * * * *